US009546770B2

(12) United States Patent
Wu

(10) Patent No.: US 9,546,770 B2
(45) Date of Patent: Jan. 17, 2017

(54) SHADE STRUCTURE

(71) Applicant: W. K. WU PRODUCTS INC., New Taipei (TW)

(72) Inventor: Wilson Wu, Taipei (TW)

(73) Assignee: W.K. WU PRODUCTS INC., New Taipei (TW)

( * ) Notice: Subject to any disclaimer, the term of this patent is extended or adjusted under 35 U.S.C. 154(b) by 268 days.

(21) Appl. No.: 14/543,648

(22) Filed: Nov. 17, 2014

(65) Prior Publication Data

US 2015/0204506 A1 Jul. 23, 2015

(30) Foreign Application Priority Data

Jan. 22, 2014 (CN) ..... 2014 2 0040540 U

(51) Int. Cl.

| | |
|---|---|
| ***F21V 1/14*** | (2006.01) |
| ***F21V 1/26*** | (2006.01) |
| ***F21V 1/04*** | (2006.01) |
| ***F21V 17/10*** | (2006.01) |
| *F21V 1/16* | (2006.01) |
| *F21V 17/00* | (2006.01) |

(52) U.S. Cl.

CPC ..... *F21V 1/143* (2013.01); *F21V 1/04* (2013.01); *F21V 1/26* (2013.01); *F21V 17/108* (2013.01); *F21V 1/16* (2013.01); *F21V 17/007* (2013.01)

(58) Field of Classification Search

CPC ..... F21V 1/02; F21V 1/04; F21V 1/12; F21V 1/16; F21V 1/26; F21V 1/143; F21V 1/22; F21V 1/14

See application file for complete search history.

(56) References Cited

U.S. PATENT DOCUMENTS

| | | | | |
|---|---|---|---|---|
| 2,606,280 A * | 8/1952 | Stroschein | F21V 1/00 | 362/357 |
| 2,622,190 A * | 12/1952 | Sher | F21V 1/00 | 362/358 |
| 2,727,983 A * | 12/1955 | Weisbrod | F21V 1/00 | 362/358 |
| 4,212,052 A * | 7/1980 | Chambard | F21V 1/06 | 362/352 |
| 5,662,412 A * | 9/1997 | Glendmyer | F21V 1/26 | 362/351 |
| 6,729,747 B1 * | 5/2004 | Wirayani | F21V 1/12 | 362/355 |

(Continued)

*Primary Examiner* — Hargobind S Sawhney

(74) *Attorney, Agent, or Firm* — Muncy, Geissler, Olds & Lowe, P.C.

(57) ABSTRACT

A shade structure comprises a frame and a shading cover. The frame is constructed by an upper and lower frame parallel to each other, and two outer lateral surfaces of the upper and lower frame have two first buckling modules respectively. The shading cover comprises a decorating layer and a support layer. The decorating layer is disposed at the outer lateral surface of the support layer. The shade structure features that the two upper and lower edges of an outer lateral surface of the decorating layer are fastened with a second buckling module via a suture, and the two upper and lower edges are bent reversely from an outer lateral surface to an inner lateral surface of the support layer, so as to hide the suture in the inner lateral surface of the support layer, and the second buckling module is integrated with the two first buckling modules as one body.

8 Claims, 5 Drawing Sheets

(56) References Cited

U.S. PATENT DOCUMENTS

| | | | | |
|---|---|---|---|---|
| 7,347,593 | B1 * | 3/2008 | Swanson | B41M 1/40 362/351 |
| 8,292,476 | B2 * | 10/2012 | Wu | F21V 1/06 362/352 |
| 8,668,367 | B2 * | 3/2014 | Anderson | F21V 1/12 362/357 |
| 8,992,054 | B1 * | 3/2015 | Grollmus | F21V 1/12 362/351 |
| 9,121,572 | B2 * | 9/2015 | Lewis | F21V 1/02 |
| 2012/0320605 | A1 * | 12/2012 | Wu | F21V 1/143 362/351 |

* cited by examiner

SHADE STRUCTURE

BACKGROUND OF THE INVENTION

1. Field of the Invention

The present invention generally relates to a shade structure, more particularly to a shade structure that has a decorated appearance and is easily dismantled and assembled.

2. Description of the Prior Art

Lamps are very common lighting tools in houses, and are able to efficiently create a different atmosphere, so that lamp is an important part in the field of modern residential design. Depending on location and illumination, such as direct illumination, indirect illumination, etc., traditional lamps are classified into floor lamp, wall lamp, lantern, table lamp, recessed light, etc.

Please refer to FIG. 1 and FIG. 2, a traditional lamp has a body (not shown in figure), a frame 1 disposed at the peripheral of the body, and a shading cover 2. The frame 1 is constructed by an upper frame 11 and a lower frame 12 which are parallel to each other. The shading cover 2 is firmly female-connected to the peripheral of the frame 1 in order to convert light from the body into diffused light. The shading cover 2 is female-connected to the frame 1 through a buckling module 5. For the case, the buckling module 5 is a pair of Velcros, including a hook and a loop. More specifically, two upper and lower edges of an inner lateral surface of the shading cover 2 are stuck with two buckling modules 5 respectively via adhesive; on the other hand, outer edges of the upper frame 11 and the lower frame 12 are stuck with two buckling modules 5 respectively as well. Accordingly, the buckling modules 5 of the shading cover 2 and the buckling modules of the upper frame 11 and the lower frame 12 are stuck together when the shading cover 2 and the frame 1 are connected into a whole.

However, although the shade structure is simple, since the buckling modules 5 are stuck to the upper and lower edges of the shading cover 2 by means of adhesive, such adhesive material may be deteriorated by heat from light to cause separation of the frame 1 from the shading cover 2.

Accordingly, how to simply dismantle and assemble a shade structure in order to facilitate packaging and transport is an important issue for the present invention.

SUMMARY OF THE INVENTION

The main objective of the present invention is to provide a shade structure. The shade structure comprises a frame and a shading cover. The frame is constructed by an upper frame and a lower frame which are parallel to each other, and two outer lateral surfaces of the upper frame and the lower frame have two first buckling modules respectively. The shading cover at least comprises a decorating layer and a support layer. The decorating layer is disposed at the outer lateral surface of the support layer, and two upper and lower edges of the decorating layer are reversely bent from the outer lateral surface of the support layer to an inner lateral surface of the support layer. The present invention is characterized in that the two upper and lower edges of an outer lateral surface of the decorating layer are fastened with a second buckling module via a suture, and then the two upper and lower edges, fastened with the second buckling module, of the decorating layer are bent reversely from an outer lateral surface to an inner lateral surface of the decorating layer, so as to hide the suture in the inner lateral surface of the support layer, and the second buckling module is integrated with the two first buckling modules 111 and 121 of the upper frame 11 and the lower frame 12 as a whole. So that the appearance of the shade structure is totally decorated (hidden suture), and the shade structure is easily dismantled and assembled.

Accordingly, the decorating layer is made of fabric.

Accordingly, the support layer is made of a heat-resistant material, a harden material, etc., as polyethylene (PE), polypropylene (PP), etc.

Accordingly, the decorating layer is higher than the support layer.

Accordingly, the decorating layer is longer than the support layer.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objectives.

Figure 1:
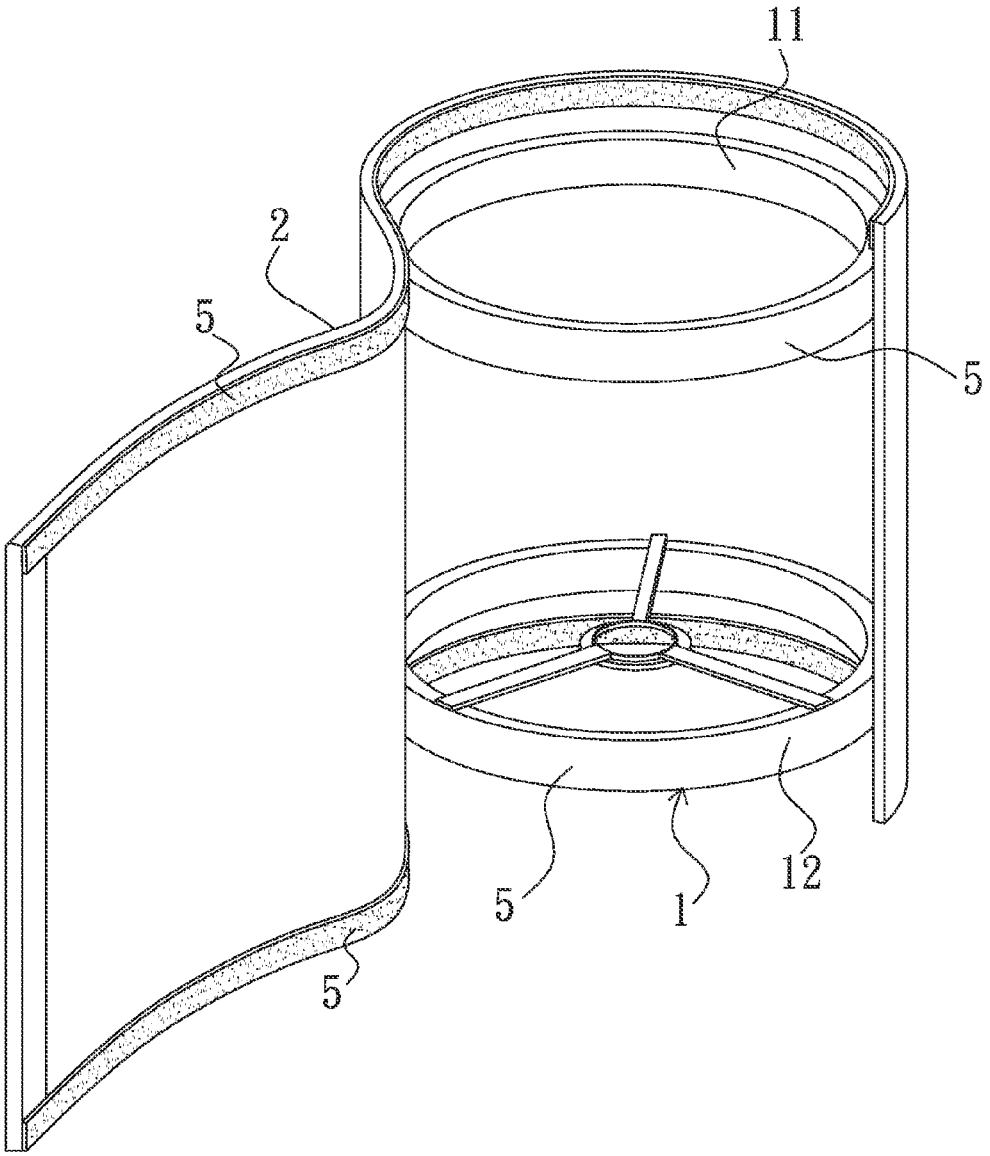
FIG. 1 (PRIOR ART)
FIG. 1 illustrates a schematic 3-dimensional view of a shade structure in prior arts.
Figure 2:
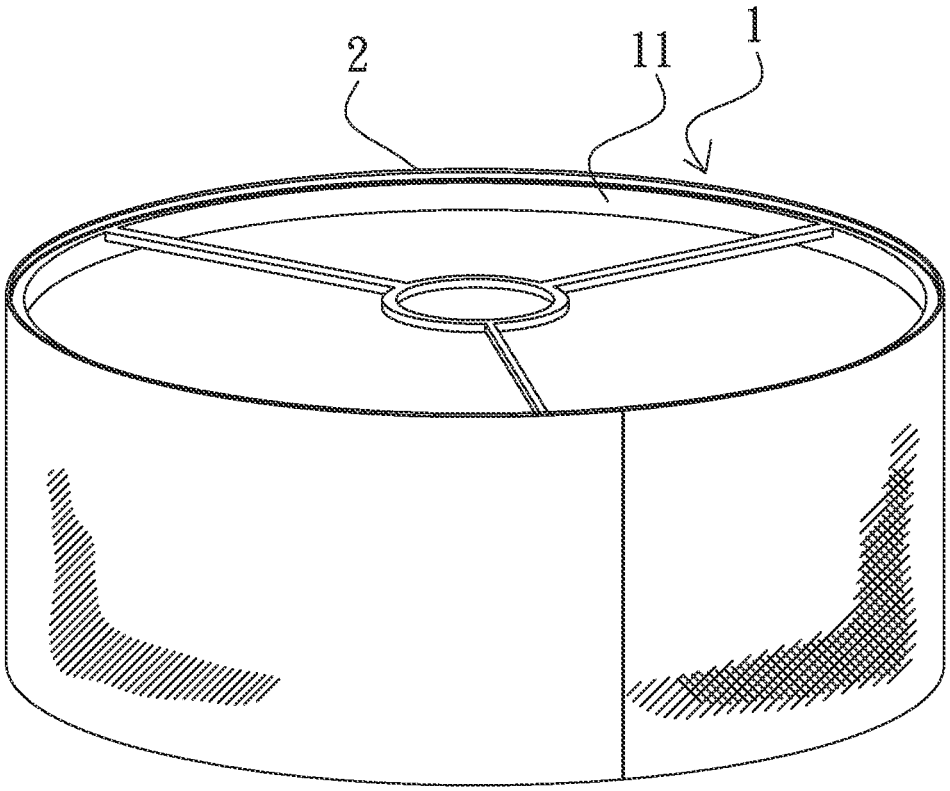
FIG. 2 (PRIOR ART)
FIG. 2 illustrates a schematic 3-dimensional assembled view of the shade structure in prior arts.
Figure 3:
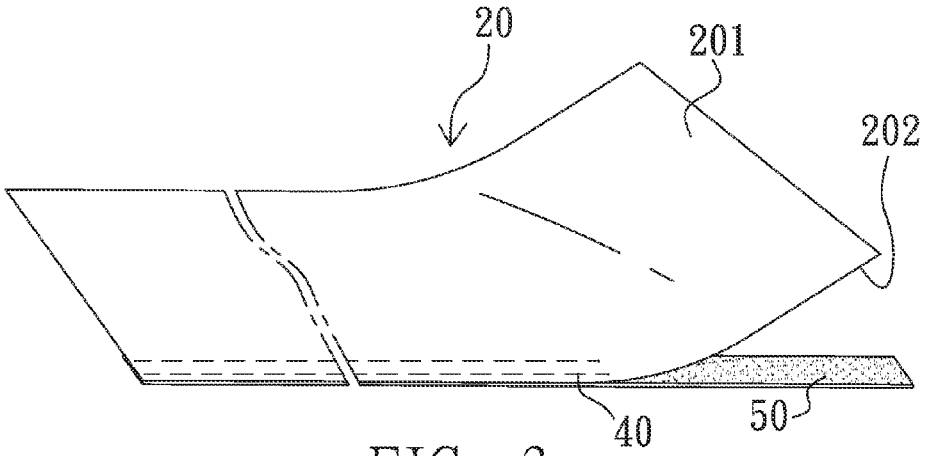
FIG. 3 illustrates a 3-dimensional view of a decorating layer of the shade structure of the present invention, and it shows that two upper and lower edges of an outer lateral surface of the decorating layer are fastened with a second buckling module via a suture.
Figure 4:
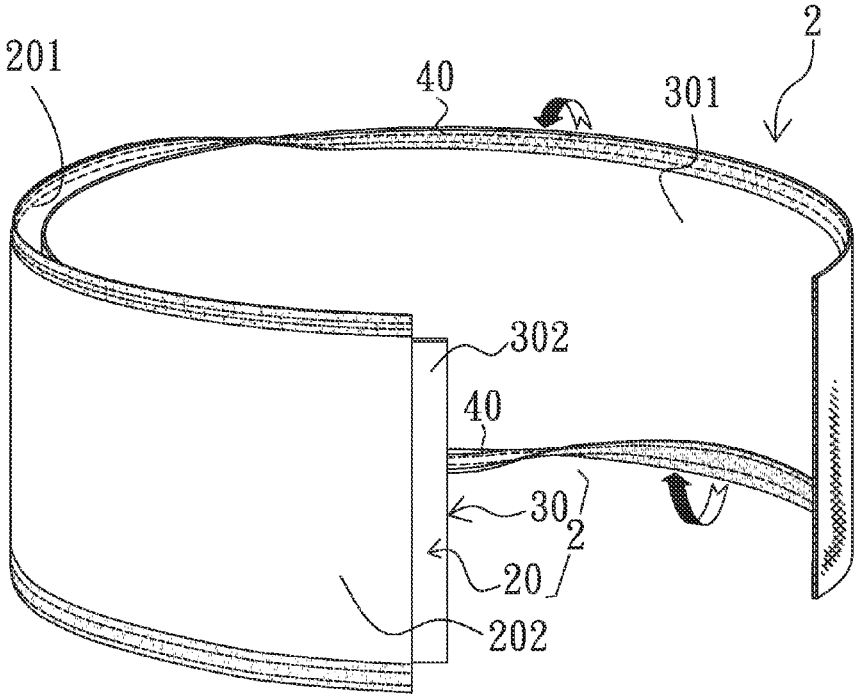
FIG. 4 illustrates a 3-dimensional assembled view of the decorating layer of the shade structure of the present invention, and it shows that the upper and lower edges are reversely bent from an outer lateral surface of a support layer to an inner lateral surface of the support layer in order to hide the suture.
Figure 5:
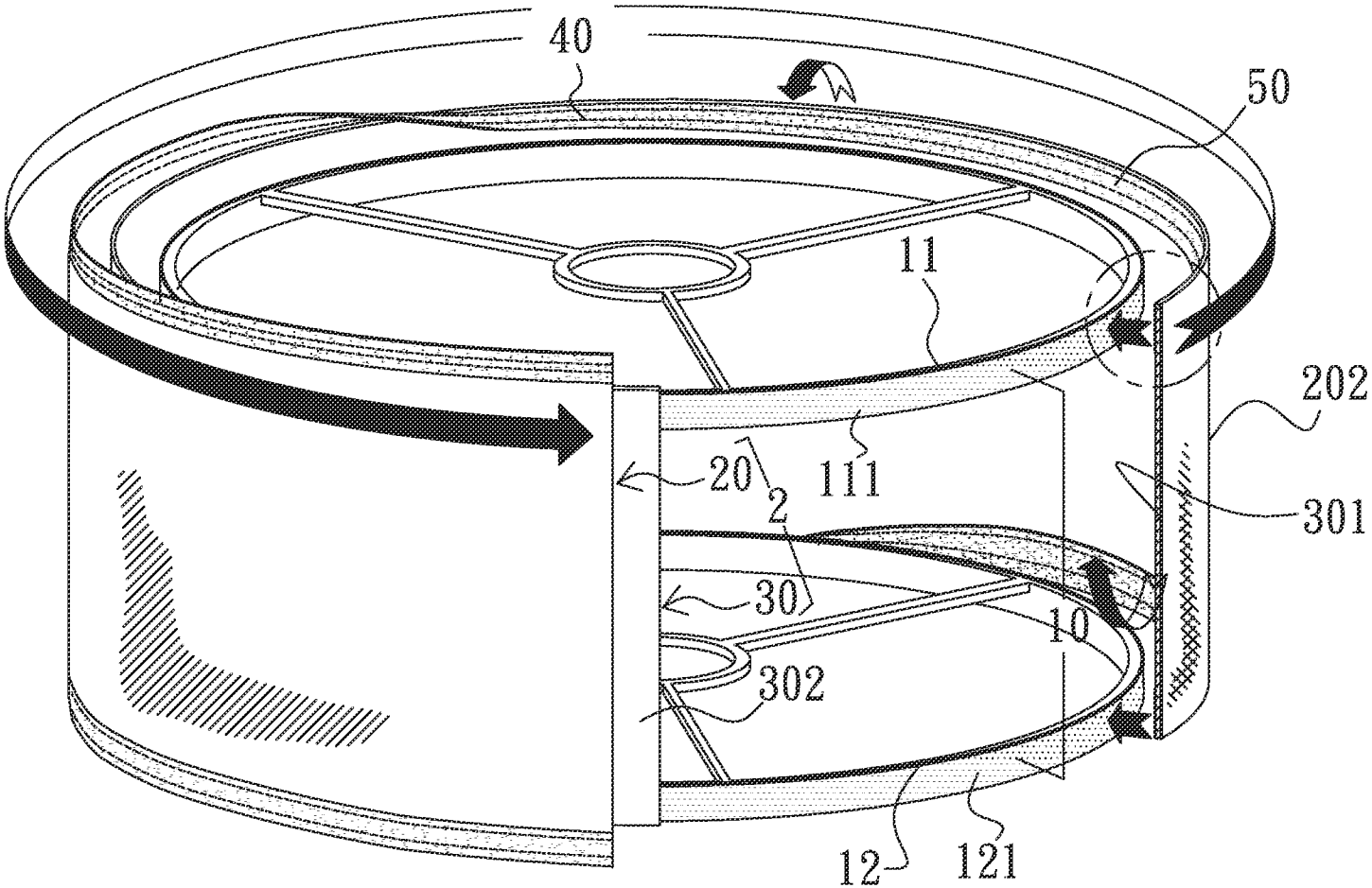
FIG. 5 and FIG. 6 illustrate a 3-dimensional assembled view of the shade structure of the present invention and a partially enlarged cross-sectional view of the present invention, and they show that the upper and lower edges of the decorating layer are reversely bent from the outer lateral surface of the support layer to the inner lateral surface of the support layer, so as to integrate the decorating layer with a frame as a whole.
Figure 6:
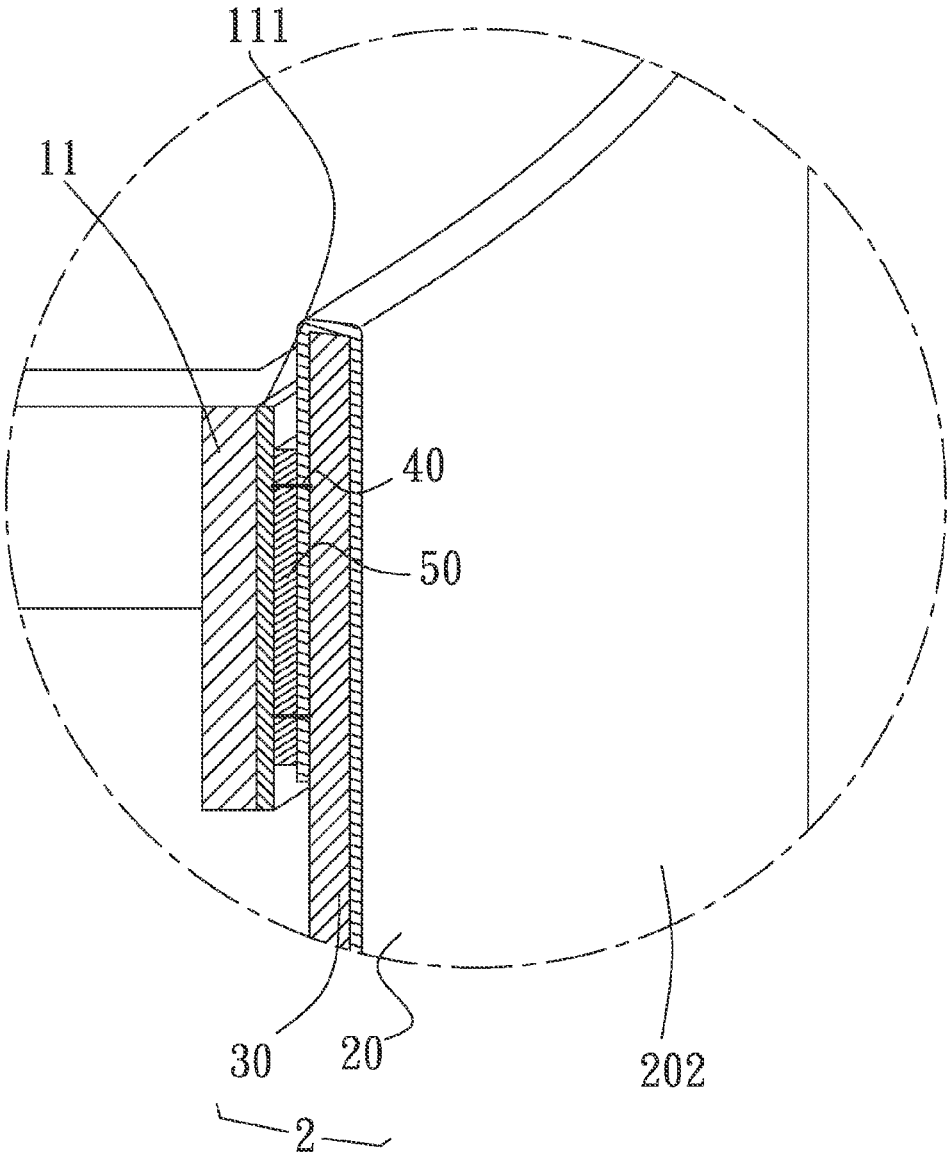

Please refer to FIG. 3 to FIG. 5, as shown in figures, the present invention provides a shade structure. The shade is constructed by at least one frame 10 and at least one shading cover 2, and the frame 10 and the shading cover 2 are integrated as a whole. The frame 10 is constructed by an upper frame 11 and a lower frame 12 which are parallel to each other, and two outer lateral surfaces of the upper frame 11 and the lower frame 12 have two first buckling modules 111 and 121 respectively. The shading cover 2 at least has a decorating layer 20 and a support layer 30, and an inner lateral surface 201 of the decorating layer 20 is stuck on the outer lateral surface 302 of the support layer 30 correspondingly. Two upper and lower edges of the decorating layer 20 are reversely bent from the outer lateral surface 302 of the support layer 30 to an inner lateral surface 301 of the support layer 30. Therefore the present invention is characterized in that the two upper and lower edges, as shown in FIG. 3, of an outer lateral surface 202 of the decorating layer 20 are fastened with a second buckling module 50 via a suture 40, and then the two upper and lower edges of the decorating layer 20 are bent reversely, so as to bend the second buckling module 50 from the outer lateral surface 302 of the support layer 30 to the inner lateral surface 301 of the support layer 30. Continuously, the suture 40 exposed to the outer lateral surface 202 of the decorating layer 20 is thus hidden in the inner lateral surface 301, as shown in FIG. 4, and the second buckling module 50 is integrated with the two first buckling modules 111 and 121 of the upper frame 11 and the lower frame 12 as a whole, as shown in FIG. 5. More specifically, the decorating layer 20 of the shading cover 2 is constructed by fabrics of curtain, tablecloth, etc. The support layer 30 is to sustain the decorating layer 20 for more stereo and harder. The support layer 30 is constructed by a heat-resistant material of polyethylene, polypropylene, etc. The decorating layer 20 and the support layer 30 are in shape of sheet, and the differences between them are that the decorating layer 20 has a larger length and height compared to the support layer 30, so that the upper and lower edges of the decorating layer 20 are bent reversely to the inner lateral surface 301 of the support layer 30, as shown in FIG. 4, and therefore the suture 40 exposed to the outer lateral surface 202 of the decorating layer 20 is hidden in the inner lateral surface 301 of the support layer 30, further, the second buckling module 50 is integrated with the two first buckling modules 111 and 121 of the upper frame 11 and the lower frame 12 respectively, as shown in FIG. 6.

The main advantages are described as the following. The upper and lower edges of the decorating layer 20 of the shading cover 2 are reversely bent to hide the second buckling module 50, and the suture 40 exposed on the outer lateral surface 202 of the decorating layer 20 hidden into the inner lateral surface 301 of the support layer 30, so that the appearance of the shade structure is totally decorated, and the shading cover 2 and the frame 10 are easily dismantled and assembled.

Accordingly, the first buckling module and the second buckling module are a pair of Velcros, including a hook and a loop, and the pair of Velcros is stuck onto two surfaces corresponding to each other. When touched to each other, the two Velcros are fastened together. Also, the hook and the loop are exchangeable in position thereof; in other words, the first buckling module and the second buckling module are as a hook and a loop corresponding to each other.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A shade structure, comprising:

at least one frame (10), constructed by an upper frame (11) and a lower frame (12) which are parallel to each other, two outer lateral surfaces of the upper frame (11) and the lower frame (12) having two first buckling modules (111, 121) respectively;

at least one shading cover (2), at least comprising:

a support layer (30), having an outer lateral surface (302);

a decorating layer (20), disposed at the outer lateral surface (302) of the support layer (30) and having one inner lateral surface (201), stuck on the outer lateral surface (302) of the support layer (30) correspondingly, two upper and lower edges of the decorating layer (20) being reversely bent from the outer lateral surface (302) of the support layer (30) to an inner lateral surface (301) of the support layer (30), wherein the two upper and lower edges of an outer lateral surface (202) of the decorating layer (20) are fastened with a second buckling module (50) via at least one suture (40), and then the two upper and lower edges of the decorating layer (20) are bent reversely, so as to bend the second buckling module (50) from the outer lateral surface (302) to the inner lateral surface (301), the suture (40) thus being hidden in the inner lateral surface (301), and the second buckling module (50) being integrated with the two first buckling modules (111, 121) of the upper frame (11) and the lower frame (12) as a whole.

2. The shade structure according to claim 1, wherein the decorating layer (20) is made of fabric.

3. The shade structure according to claim 2, wherein the fabric is selected from a group of curtain fabric and tablecloth.

4. The shade structure according to claim 1, wherein the support layer (30) is made of a heat-resistant material.

5. The shade structure according to claim 1, wherein the support layer (30) is constructed by polyethylene (PE) and polypropylene (PP).

6. The shade structure according to claim 1, wherein the decorating layer (20) or the support layer (30) is in shape of sheet.

7. The shade structure according to claim 1, wherein the decorating layer (20) is larger than the support layer (30) in height.

8. The shade structure according to claim 1, wherein the decorating layer (20) is larger than the support layer (30) in length.

* * * * *